US007905570B2

(12) United States Patent
Ito

(10) Patent No.: US 7,905,570 B2
(45) Date of Patent: Mar. 15, 2011

(54) INKJET HEADS

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1019 days.

(21) Appl. No.: 11/693,963

(22) Filed: Mar. 30, 2007

(65) Prior Publication Data

US 2007/0242109 A1 Oct. 18, 2007

(30) Foreign Application Priority Data

Mar. 31, 2006 (JP) ..... 2006-097266

(51) Int. Cl.
*B41J 2/015* (2006.01)
*B41J 2/175* (2006.01)

(52) U.S. Cl. ..... 347/20; 347/85

(58) Field of Classification Search ..... 347/20, 347/70–71, 85
See application file for complete search history.

(56) References Cited

U.S. PATENT DOCUMENTS

| | | | | |
|---|---|---|---|---|
| 2005/0140741 | A1* | 6/2005 | Kubo | 347/67 |
| 2005/0140754 | A1 | 6/2005 | Hirota et al. | |
| 2005/0157104 | A1* | 7/2005 | Hirota et al. | 347/85 |
| 2005/0168537 | A1 | 8/2005 | Hibi | |
| 2006/0092235 | A1* | 5/2006 | Sugahara | 347/65 |

FOREIGN PATENT DOCUMENTS

| | | | |
|---|---|---|---|
| JP | 05241148 A | * | 9/1993 |
| JP | H05-241148 A | | 9/1993 |
| JP | 2002-103577 A | | 4/2002 |
| JP | 2005169839 A | | 6/2005 |
| JP | 2005-186375 A | | 7/2005 |
| JP | 2005-212374 A | | 8/2005 |

OTHER PUBLICATIONS

Japan Patent Office; Notice of Reasons for Rejection in Japanese Patent Application No. 2006-097266 (counterpart to the above-captioned U.S. patent application) mailed Jan. 19, 2010.

* cited by examiner

*Primary Examiner* — Julian D Huffman
*Assistant Examiner* — Jason S Uhlenhake
(74) *Attorney, Agent, or Firm* — Baker Botts L.L.P.

(57) ABSTRACT

An inkjet head includes a flow passage unit having an ink flow passage formed therein, in which ink flows, and an actuator unit secured to the flow passage unit. The actuator unit is configured to apply a discharge energy to the ink within the ink flow passage. The inkjet head also includes a driver IC configured to supply a drive signal to the actuator unit, a plurality of plates extending from the flow passage unit, and a cover member secured to the plurality of plates. The cover member, the plurality of plates, and the flow passage unit define a closed space, and the driver IC is disposed within the closed space. Moreover, the driver IC opposes at least a portion of an inside surface of one of the plurality of plates and is thermally coupled to the one of the plurality of plates, and an outside surface of the one of the plurality plates has a heat radiation property which is greater than a heat radiation property of the inside surface of the one of plurality of plates.

10 Claims, 11 Drawing Sheets

MAIN SCANNING DIRECTION

SUBSCANNING DIRECTION

INKJET HEADS

BACKGROUND OF THE INVENTION

1. Field of the Invention

The present invention relates generally to inkjet heads for discharging ink onto a recording medium.

2. Description of Related Art

A known inkjet head, such as the inkjet head described in Japanese Patent Application Publication No. JP-A-2005-169839, includes a head main body for discharging the ink, a head control portion for controlling the head main body, and an upper and a lower cover for protecting the head control portion from ink splash. In the known inkjet head, the head main body includes a flow passage unit having a plurality of individual ink flow passages leading to a nozzle, and an actuator unit for changing the volume of individual ink flow passages. The head control portion includes a main board, a plurality of sub-boards electrically connected to the main board and arranged to sandwich the main board, and a driver integrated circuit ("IC") which includes a heat sink secured to the surface of the sub-boards opposed to the main board. The sub-boards and the driver IC are electrically connected to a flexible printed circuit ("FPC") with one end electrically connected to the actuator unit. The FPC conveys a signal outputted from the main board via the sub-boards to the driver IC, and conveys a drive signal outputted from the driver IC to the actuator unit. The actuator unit receives the drive signal, and changes the volume of some of the individual ink flow passages and applies pressure to the ink within the individual ink flow passages. In this manner, the ink is discharged from the nozzle, such that a desired image is formed on the paper.

Nevertheless, in the known inkjet head, because the heat sink is covered with an upper cover, the heat generated by the driver IC and the heat sink is captured within the cover. Consequently, the temperature and humidity of space within the inkjet head surrounded by the upper and lower covers increases. Moreover, an external stress is applied on the junction between the connector of the FPC and the electronic parts, and whisker may grow in the connector or the junction of the FPC. Particularly, if the joint member includes a tin based material which does not include lead, the whisker may grow. In addition, the FPC has a narrower pitch with higher wiring density and shorter terminal distance, along with the higher density of the actuator unit, whereby there is a risk that the electrical short circuit occurs due to whisker. A known method for suppressing whisker involves coating gold or adding silver, which increases costs. Further, because the ink temperature within the head main body rises, the ink discharge characteristics vary.

SUMMARY OF THE INVENTION

Therefore, a need has arisen for inkjet heads which overcome these and other shortcomings of the related art. A technical advantage of the present invention is that the closed space inkjet head is less likely to be heated by radiated heat than the known inkjet heads.

According to an embodiment of the present invention, an inkjet head comprises a flow passage unit having an ink flow passage formed therein, in which ink flows, and an actuator unit secured to the flow passage unit. The actuator unit is configured to apply a discharge energy to the ink within the ink flow passage. The inkjet head also comprises a driver IC configured to supply a drive signal to the actuator unit, a plurality of plates extending from the flow passage unit, and a cover member secured to the plurality of plates. The cover member, the plurality of plates, and the flow passage unit define a closed space, and the driver IC is disposed within the closed space. Moreover, the driver IC opposes at least a portion of an inside surface of one of the plurality of plates and is thermally coupled to the one of the plurality of plates, and an outside surface of the one of the plurality plates has a heat radiation property which is greater than a heat radiation property of the inside surface of the one of plurality of plates.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS

Embodiments of the present invention and their features and technical advantages may be understood by referring to FIGS. 1-11, like numerals being used for like corresponding portions in the various drawings.

Figure 1:
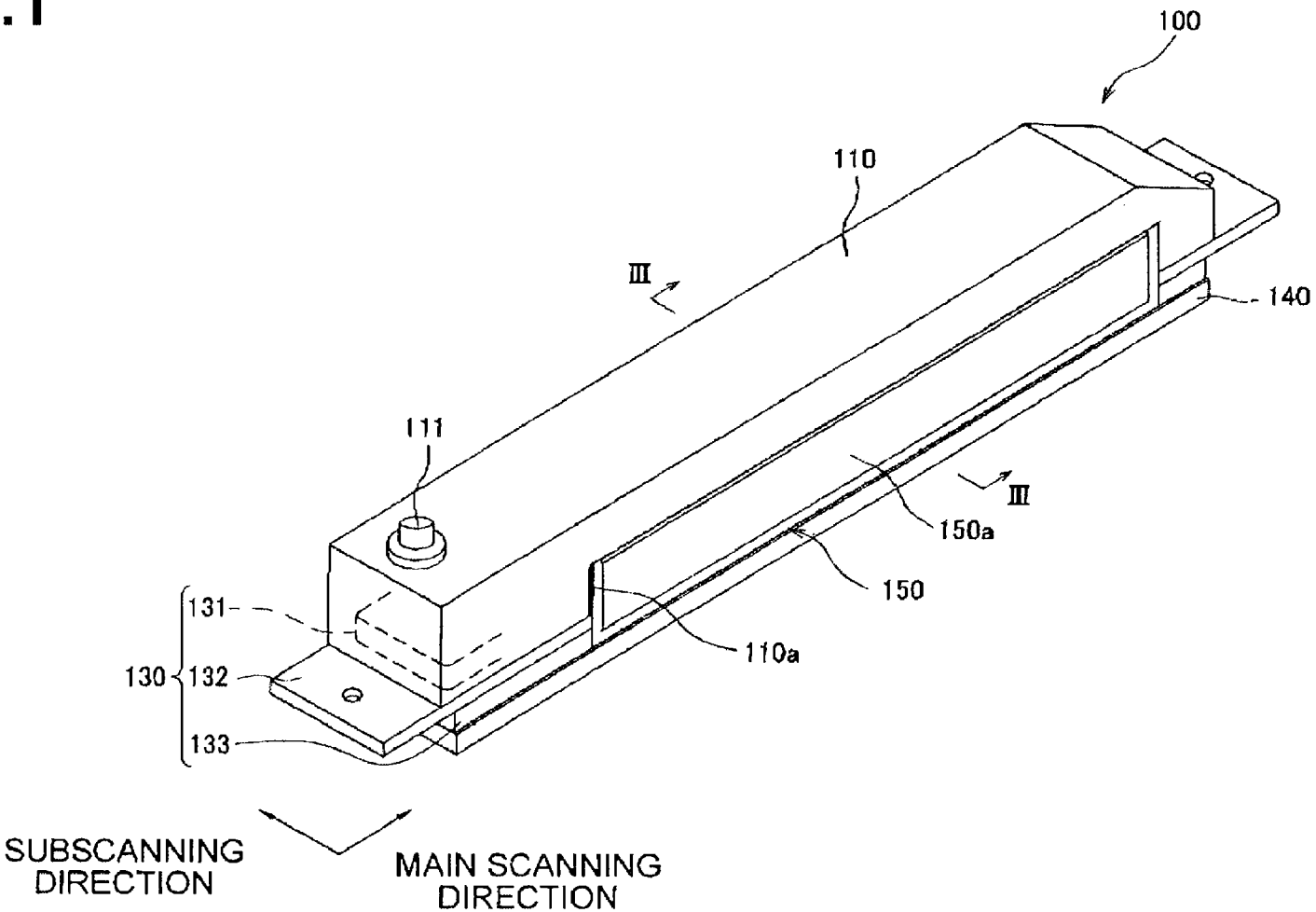
FIG. 1 is a perspective view of an inkjet head, according to an embodiment of the present invention.

Referring to FIG. 1, an inkjet head 100 may have a elongated shape in one direction in a plan view. In this embodiment, a main scanning direction is the longitudinal direction in a plan view of the inkjet head 100, and a subscanning direction is the direction vertical to the main scanning direction. Moreover, a lower direction is the discharge direction of the ink discharged from the inkjet head 100, and an upper direction is the opposite direction to the lower direction.

The inkjet head 100 may comprise a flow passage unit 140 comprising a ink discharge port 8, such as a nozzle, on its under surface/ink discharge face, and an ink reservoir 130 for supplying the ink to the flow passage unit 140. Inkjet head 100 also may comprise a head cover 110 disposed on the ink reservoir 130, and an electric circuit for controlling the inkjet head 100 may be accommodated within its internal space. Each of the ink reservoir 130 and the flow passage unit 140 may have a rectangular shape, with its long side being parallel to the main scanning direction.

Figure 2:
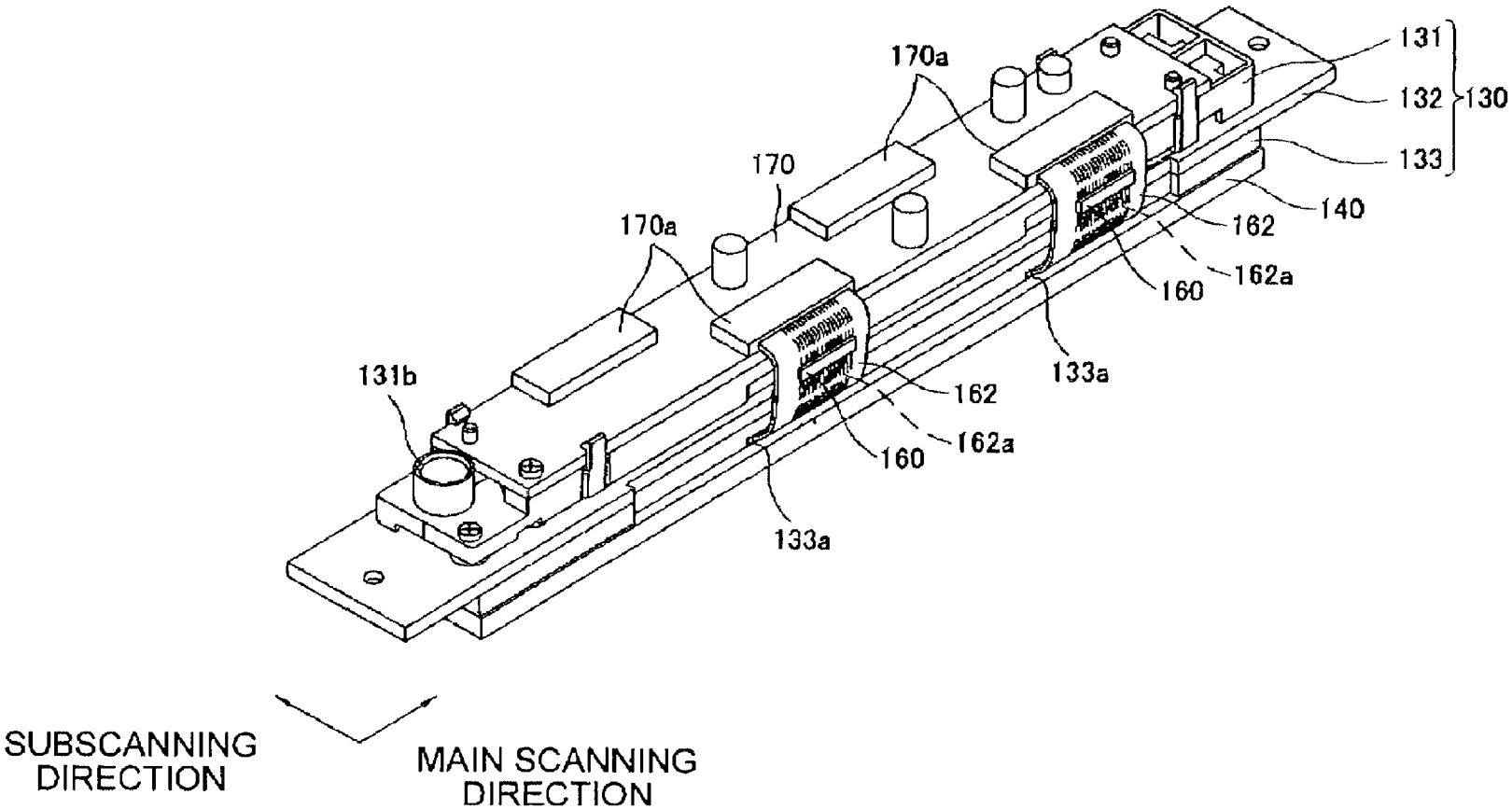
FIG. 2 is a perspective view of the internal components of the inkjet head of FIG. 1.

Referring to FIG. 2, the ink reservoir 130 may be a laminated structure comprising three plates, in which a lower reservoir 133 on the side of the flow passage unit 140, a reservoir base 132 and an upper reservoir 131 are laminated in this order. The reservoir base 132 may have a through hole/ink flow passage 136 formed there through, which is in fluid communication with an ink reservoir of the lower reservoir 133. Moreover, the electric circuit may comprise a control board 170 laminated on the upper reservoir 131.

The head cover 110 may have a box-like shape opened downward. The head cover 110 may be positioned on the reservoir base 132 to cover various components, such as the upper reservoir 131 on the reservoir base 132. An ink supply valve 111 may be positioned on an upper surface of the head cover 110 to supply the ink into an ink flow passage 135 formed inside the ink reservoir 130 through the ink supply valve 111.

An opening 110*a* may be formed on the side face of the head cover 110. The opening 110*a* may be formed by cutting out the side face of the head cover 110 along the vertical direction of the head cover 110 from the lower end of the side face up to the neighborhood of the center of the side face. The opening 110*a* may have a rectangular shape, with its long side being parallel to the main scanning direction. Moreover, the short side of the opening 110*a* may be parallel to the vertical direction. On the side face of the inkjet head 100, a heat sink 150 may be positioned inside the head cover 110. In this embodiment, a flat protrusion 150*a* formed on the heat sink 150 is exposed via the opening 110*a* from the head cover 110. The inkjet head 100 has a clearance between each member sealed with a seal member (not shown), such that the space surrounded by the head cover 110, the heat sink 150, the reservoir base 132, and the flow passage unit 140 may be the closed space.

The inkjet head 100 may be applied to image recording apparatus, such as an inkjet printer. For example, when the inkjet head 100 is applied to the inkjet printer, the inkjet head 100 may be arranged, such that the main scanning direction is the direction of the length and the subscanning direction is the direction of the width in a plan view. When the paper is conveyed to the position opposite to the nozzle 8 formed on the under surface of the flow passage unit 140, the ink is discharged from the nozzle 8, such that the character and image are formed on the paper. The ink for use in the inkjet head 100 may be supplied from an ink cartridge provided on the inkjet printer via an ink tube connected to the ink supply valve 111.

Referring to FIG. 2, an ink supply port 131*b* may be formed on an upper surface of the ink reservoir 130. The ink supply port 131*b* is in fluid communication with the ink supply valve 111 provided on the upper surface of the head cover 110.

The control board 170 above the upper reservoir 131 may have a rectangular shape that is elongated in the main scanning direction. The length of the control board 170 and the length of the upper reservoir 131 may be substantially the same in the subscanning direction. Various kinds of electronic components, such as an IC chip or a condenser, may be fixed on the upper surface of the control board 170, in which a number of wirings are provided. On the control board 170, various processors and storage units are constructed by these electronic parts and wirings. The storage unit constructed on the control board 170 stores data denoting the program for controlling the inkjet head 100 and temporary working data. The processor constructed on the control board 170 controls the operation of the inkjet head 100 based on this data.

Four connectors 170*a* may be fixed on the upper surface of the control board 170. The connectors 170*a* are electrically connected to various processors and storage units constructed on the control board 170. The four connectors 170*a* may be arranged in two rows in a staggered form in the main scanning direction.

Figure 3:
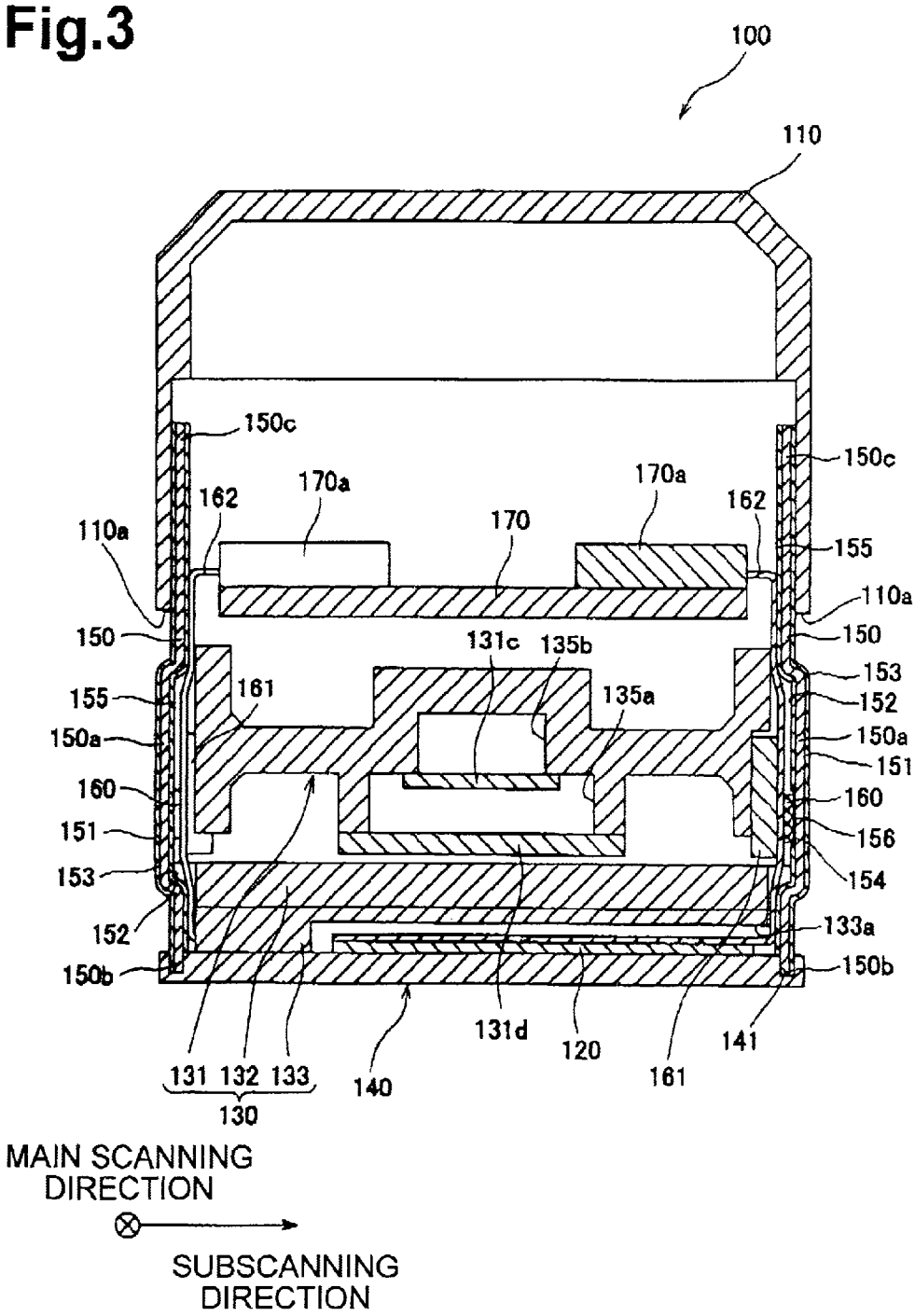
FIG. 3 is a cross-sectional view along the line III-III of FIG. 1.

One end of an FPC 162 may be connected to the side face of each connector 170*a*. The FPC 162 may be a flexible sheet member formed with a plurality of wirings 162*a* inside. Moreover, a driver IC 160 may be mounted on the FPC 162 and may be electrically connected to the wirings 162*a*. Referring to FIGS. 2 and 3, the FPC 162 is passed from the connector 170*a* along the side face of the ink reservoir 130 downward, and passed through an opening 133*a* formed on the side face of the lower reservoir 133, such that the driver IC 160 may be disposed at the position opposite to the flat protrusion 150*a* of the heat sink 150 and sideways of the ink reservoir 130, as shown in FIGS. 2 and 3. The other end of the FPC 162 is electrically connected to the actuator unit 120 secured on the upper surface of the flow passage unit 140.

The driver IC 160 may be an IC chip for driving the actuator unit 120. The driver IC 160 may have a shape which is long the main scanning direction and flat in the subscanning direction. The driver IC 160 is urged, together with the FPC 162, to the heat sink 150 by an elastic member 161 provided on the side face of the upper reservoir 131 at the position opposite to the heat sink 150.

Figure 4:
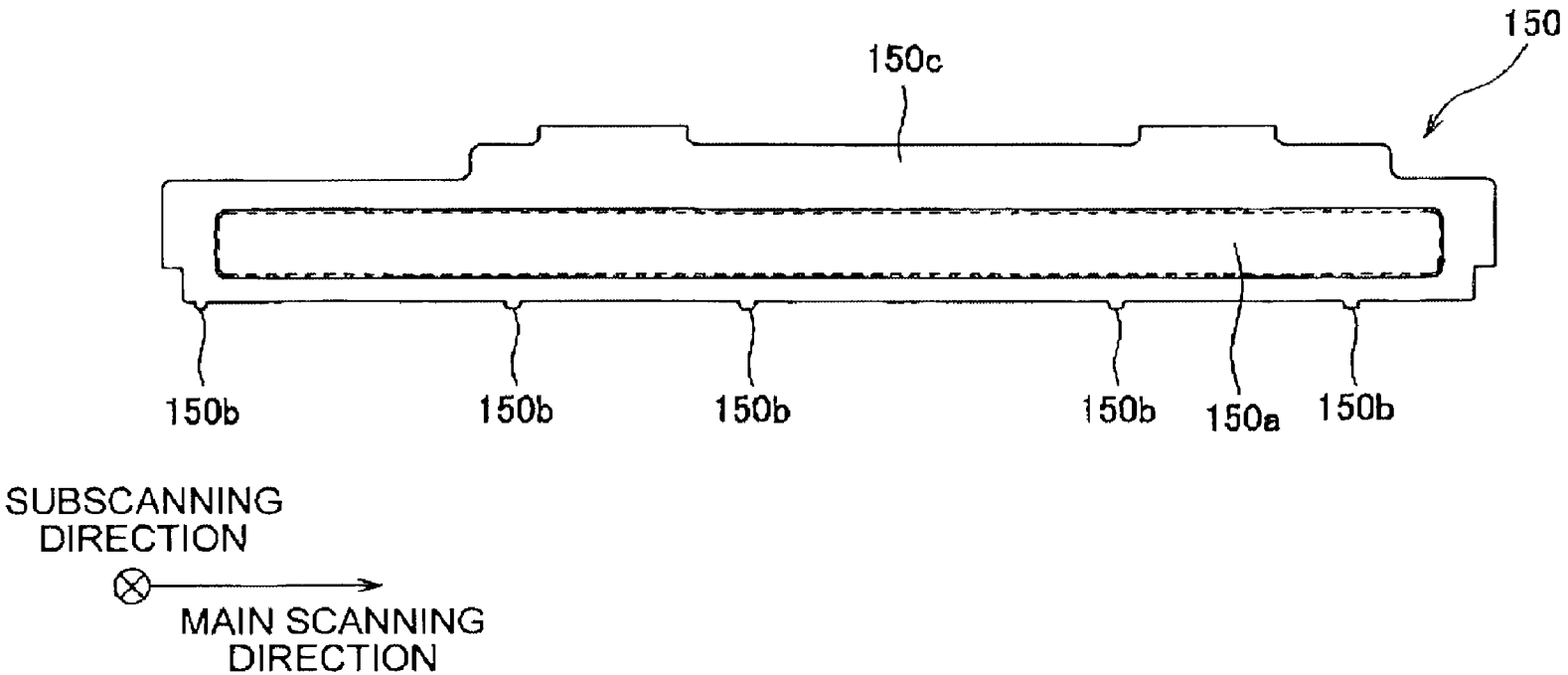
FIG. 4 is a side view of a heat sink.

The heat sink 150 may protrude from the upper surface at either end in the subscanning direction of the flow passage unit 140. Referring to FIG. 4, each of the heat sinks may comprise aluminum metal, and may have substantially rectangular shape in which the main scanning direction is the direction of the length. The heat sink 150 may comprise a flat protrusion 150*a*, a projection 155*b*, and a protrusion 150*c*. The flat protrusion 150*a* is formed in a portion of the heat sink 150 opposed to the side face of the upper reservoir 131 to protrude from the opening 110*a*. A top end of the flat protrusion 150*a* protruding from the opening 110*a* may be flat and may have a rectangular shape which is elongated in the main scanning direction. The flat protrusion 150*a* may be formed by press working a metal sheet. In this manner, the flat protrusion 150*a* is formed on the heat sink 150, whereby the heat sink 150 has a wider surface area and an increased rigidity.

The projection 150*b* projects from the lower end of the heat sink 150 downwards. For example, five projections 150*b* may be positioned along the main scanning direction. The width of the upper surface of the flow passage unit 140 may be greater than the width of the under surface of the ink reservoir 130, and the ink reservoir 130 may be disposed in the center of the flow passage unit 140 in the subscanning direction. Consequently, an area not opposed to the under surface of the ink reservoir 130 exists near either end of the flow passage unit 140 in the subscanning direction. In this area, five concave portions 141 may be formed at the positions corresponding to the five projections 150*b*. Moreover, the concave portions 141 may have a size and shape which snuggly fits with the projections 150*b* of the heat sink 150. Because the projections 150*b* are fitted into the concave portions 141, the heat sink 150 is spaced from the flow passage unit 140. The protrusion 150*c* may protrude from the upper end of the heat sink 150 upwards, and may have a substantially rectangular shape in which the main scanning direction is the direction of the length. Referring to FIG. 3, the protrusion 150*c* contacts the inside of the side face of the head cover 110 to secure the head cover 110.

Figure 5:
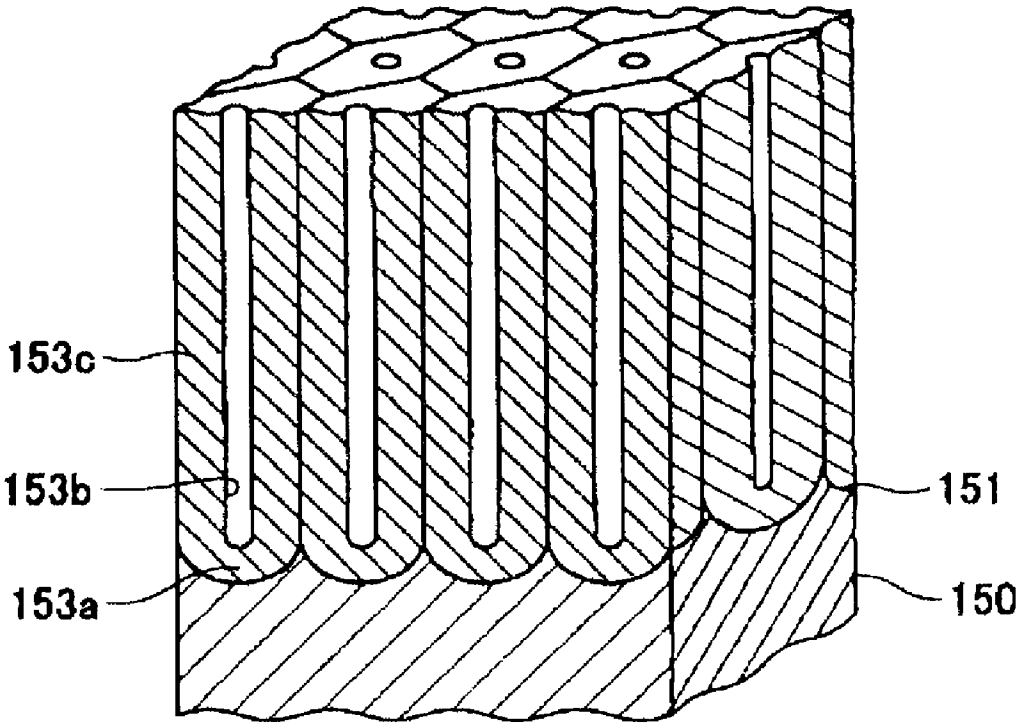
FIG. 5 is a partial, cross-sectional perspective view of a porous film formed on the outside surface of the heat sink.

A porous film 153, which may be made a known anodizing process with dilute sulfuric acid as the electrolytic solution, may be positioned on an outside surface 151 of the heat sink 150. Referring to FIG. 5, the porous film 153 may comprise a barrier layer 153*a* formed adjacent to the boundary with the outside surface 151 of the heat sink 150, and a plurality of cells 153*c*, which may form hexagonal columns, each having a micropore 153*b* formed substantially in the center thereof. In this manner, the plurality of micropores 153*b* may be formed in the porous film 153, whereby the surface area of the outside surface of the heat sink 150 is substantially greater than the inside surface 152. Therefore, the heat radiation characteristic on the outside surface of the heat sink 150 may be greater than the inside surface 152, such that heat conveyed to the heat sink 150 is passed from the inside surface 152 to the outside surface 151 and radiated from the heat sink 150. Moreover, the porous film 153 may be black, and because the micropore 153*b* is formed in the cell 153*c*, the porous film 153 may be formed black by dipping the heat sink 150 in the dyestuff to fill the dyestuff in the micropore 153*b* after the porous film 153 is formed. Alternatively, pigment may be contained into the micropore 153*b*, or a metallic salt bath may be applied. In another embodiment, a color other than black may be used. Because the porous film may be colored, heat conveyed to the inside surface 152 of the heat sink 150 may be radiated from the heat sink 150 in the direction from the inside surface 152 to the outside surface 151. Moreover, because the dyestuff fills the micropore 153*b*, contaminant or corrosive substance may not be absorbed through the micropore 153*b*, whereby the heat sink 150 is improved in the corrosiveness, weatherability, and stainability. Further, because the porous film 153 has a greater hardness than a basis material, e.g., aluminum metal, the strength of the heat sink 150 is enhanced.

In this embodiment, the heat sink 150 may comprise aluminum metal such as titanium metal, magnesium metal, or their alloy, or aluminum alloy. In this case, the porous film equivalent to the porous film 153 may be formed on the heat sink, whereby the same effect may be achieved.

Moreover, on the inside surface 152 of the heat sink 150 opposed to the FPC 162, an adiabatic layer 155 may have a through hole 154 formed there through, through which the inside surface 152 is exposed. Through hole 154 may be formed in an area opposed to the driver IC 160. Using, and via the through hole 154, the driver IC 160 may tightly contact the inside surface 152 via a heat radiation sheet 156, e.g., the heat sink 150 and the driver IC 160 may be thermally coupled. In this manner, because the driver IC 160 tightly contacts the inside surface 152, heat generated from the driver IC 160 migrates through the inside surface 152 to the heat sink 150.

The adiabatic layer 155 may comprise a rubber sheet and may have an insulating property. Referring to FIG. 3, because the adiabatic layer 155 is positioned between the FPC 162 and the heat sink 150, the FPC 162 and the heat sink 150 may not contact each other, which prevents a short circuit between the wirings 162*a*. Alternatively, the adiabatic layer 155 may comprise a sponge sheet, a sheet of polyimide resin, or paint. In the case of the sponge sheet, because a plurality of air layers are provided internally, the adiabatic property is further improved.

Moreover, the thickness of the adiabatic layer 155 may be less than or equal to the height of the driver IC 160 in the thickness direction, e.g., the subscanning direction, of the adiabatic layer 155. Thereby, even if the FPC 162 and the adiabatic layer 155 contact each other, the driver IC 160 and the inside surface 152 may be thermally coupled. Therefore, heat of the driver IC 160 is more likely to be conveyed to the inside surface 152, such that the driver IC 160 may be cooled effectively. If the thickness of the adiabatic layer is greater than the height of the driver IC 160, the distance between the driver IC 160 and the inside surface 152 is increased, when the FPC 162 and the adiabatic layer contact each other. Therefore, heat of the driver IC 162 is less likely to be conveyed to the inside surface 152.

Figure 6:
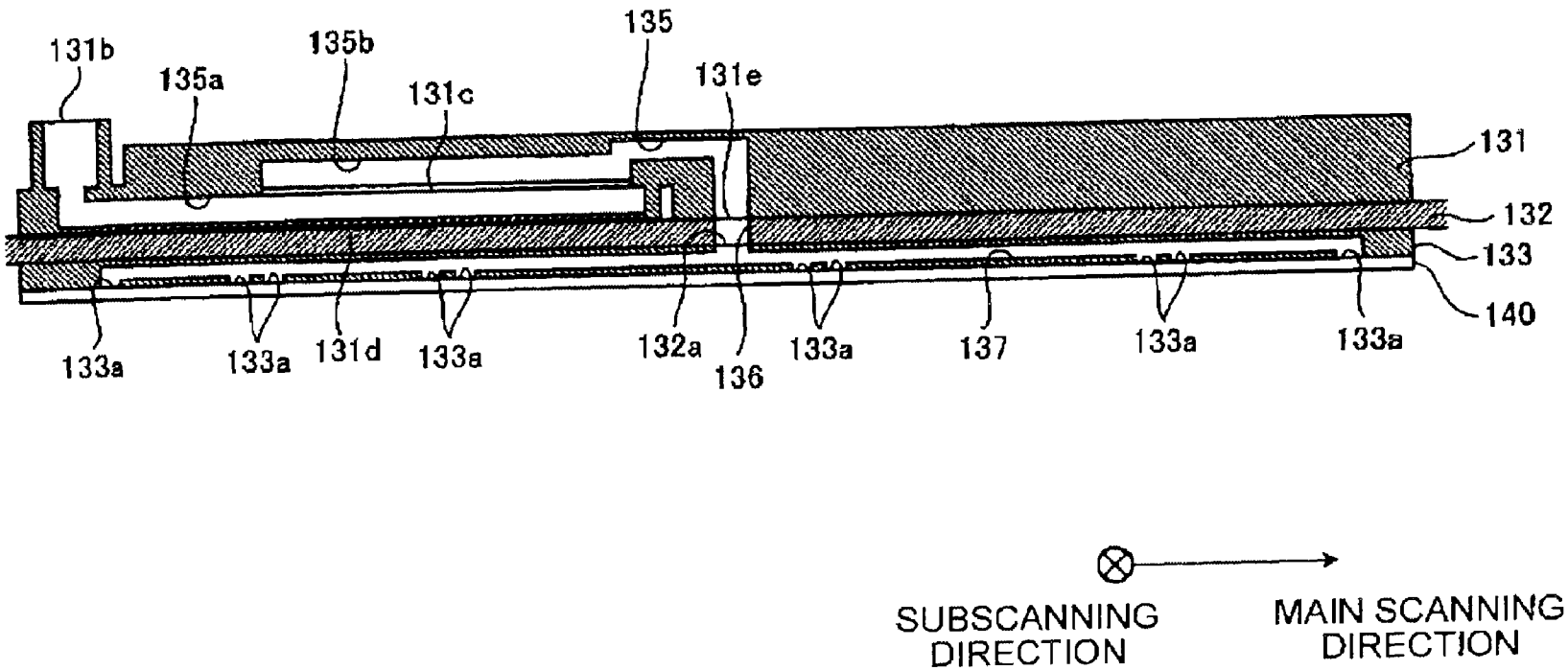
FIG. 6 is a longitudinal, cross-sectional view of an ink reservoir.

Referring to FIG. 6, an ink flow passage 135 may be formed inside the upper reservoir 131. Moreover, an ink supply port 131*b* which is one opening of the ink flow passage 135 may be formed on the upper surface of the upper reservoir 131, and an ink passage port 131*e* which is the other opening of the ink flow passage 135 may be formed on the under surface of the upper reservoir 131. The ink supply port 131*b* may be formed adjacent to one end of the upper reservoir 131 in the main scanning direction. The ink passage port 131*e* may be formed adjacent to the center of the upper reservoir 131 in both the main scanning direction and the subscanning direction.

In order to form the ink flow passage 135. The ink flow passage 135. The ink flow passage 135 first may be directed from the ink supply port 131*b* downwards, and may be in fluid communication with an extension area 135*a* extending along the under surface of the upper reservoir 131 adjacent to the under surface of the upper reservoir 131. A portion of the under surface of the upper reservoir 131 may comprise a flexible film 131*d*. The upper surface of the film 131*d* comprises a portion of the lower wall face of the extension area 135*a*. Moreover, the under surface of the film 131*d* is spaced a predetermined distance away from the reservoir base 132, and is disposed to be displaceable corresponding to this distance. Therefore, when the film 131*d* vibrates, an impact due to a pressure wave produced in the ink filled within the ink flow passage 135 is absorbed.

The extension area 135*a* may be in fluid communication with the extension area 135*b*. The extension area 135*b* may be formed above the extension area 135*a*, and may extend parallel to an extension surface of the extension area 135*a*. The extension area 135*a* and the extension area 135*b* may be segmented by a filter 131*c*, and may be in fluid communication with each other via a plurality of micropores formed in the filter 131*a*.

The ink flow passage 135 leads upwards from one end in the main scanning direction up to adjacent the upper surface of the upper reservoir 131, and bends adjacent to the upper surface of the upper reservoir 131 in the center of the upper reservoir 131 in the main scanning direction to lead along the upper surface of the upper reservoir 131 to the center of the upper reservoir 131. When it reaches adjacent to the center of the upper reservoir 131, it bends downwards to lead to the under surface of the upper reservoir 131 to be in fluid communication with the ink passage port 131*e* on the under surface of the upper reservoir 131.

The ink flow passage 136 may be formed inside the reservoir base 132. One opening of the ink flow passage 136 may be formed on the upper surface of the reservoir base 132 to be in fluid communication with the ink passage port 131*e*. An ink passage port 132*a*, which is the other opening of the ink flow passage 136, may be formed on the under surface of the reservoir base 132. The ink flow passage 136 extends downwards from the ink passage port 131*e* to the ink passage port 132*a*.

The ink flow passage 137 may be formed inside the lower reservoir 133. One opening of the ink flow passage 137 may be formed on the upper surface of the lower reservoir 133, and a plurality of ink passage ports 133*a*, which are the other openings, may be formed on the under surface. The ink passage port 133*a* may be opposed to the flow passage unit 140 and may be in fluid communication with the ink supply port 140*a* formed on the upper surface of the flow passage unit 140.

The ink flow passage 137 may comprise a first portion which extends along the main scanning direction adjacent to the center of the lower reservoir 133 in the vertical direction, a second portion which extends upwards from the first portion to the ink passage port 132*a*, and a third portion which extends downwards from the first portion to each of the ink passage ports 133*a*. The second portion may be formed at a position overlapping the ink flow passage 136 in a plan view, and the third portion may be formed at a position overlapping each of the ink passage ports 133*a* in a plan view.

In this manner, the ink supplied from the ink supply port 131*b* flows through the ink flow passages 135-137 formed in the ink reservoir 130 into the flow passage unit 140. The ink passes through the filter 131*c* to reach the flow passage unit 140, and at this time, impurities in the ink are filtered through the filter 131*c*.

Figure 7A:
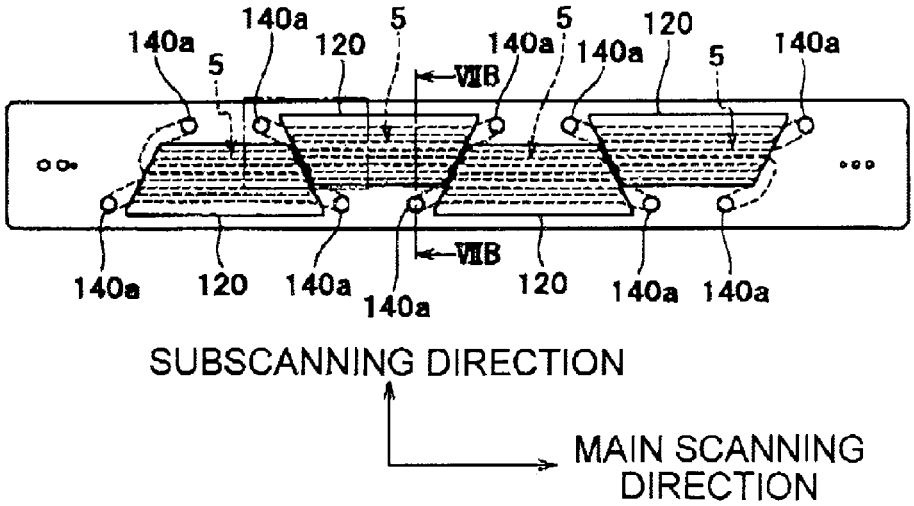
FIG. 7A is a plan view of a flow passage unit.

Referring to FIG. 7A, the actuator unit 120 may be secured on the upper surface of the flow passage unit 140. The actuator unit 120 may have a trapezoidal shape, and the actuator unit 120 may be positioned, such that a pair of parallel opposed sides may be parallel to the main scanning direction. Moreover, four actuator units 120 may be arranged in a staggered form in the main scanning direction. In the four actuator units 120, the adjacent hypotenuses on the flow passage unit 140 may overlap partially in the subscanning direction.

A manifold flow passage 5, which may be a portion of the ink flow passage, may be formed inside the flow passage unit 140. A plurality of ink supply ports 140*a* may be formed on the upper surface of the flow passage unit 140, and one end of the manifold flow passage 5 may be in fluid communication with each of the ink supply ports 140*a*. Five ink supply ports 140*a* may be formed in each of a pair of rows, and may be formed along the longitudinal direction of the flow passage unit 140. The ink supply ports 140*a* may be formed at positions which do not include the areas where the four actuator units 120 are positioned.

Figure 7B:
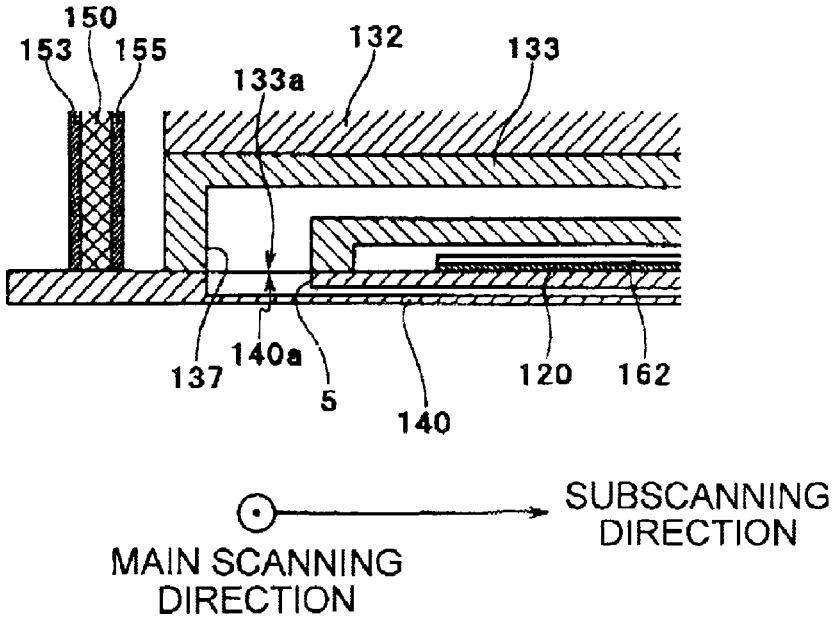
FIG. 7B is a cross-sectional view along the line VIIB-VIIB of FIG. 7A.

Referring to FIG. 7B, the ink supply port 140*a* may be in fluid communication with the ink passage port 133*a* formed in the lower reservoir 133. The ink may be supplied from the ink reservoir 130 to the manifold flow passage 5 via the ink supply port 140*a*.

The lower reservoir 133 and the flow passage unit 140 may be separated except for the position at which the ink supply port 140*a* and the ink passage port 133*a* are in fluid communication. The actuator unit 120 may be positioned in the space formed between the lower reservoir 133 and the flow passage unit 140, and may be opposed to the under surface of the lower reservoir 133. The FPC 162 may be pasted on the upper surface of the actuator unit 120, and the FPC 162 and the lower reservoir 133 may be separated.

Figure 8:
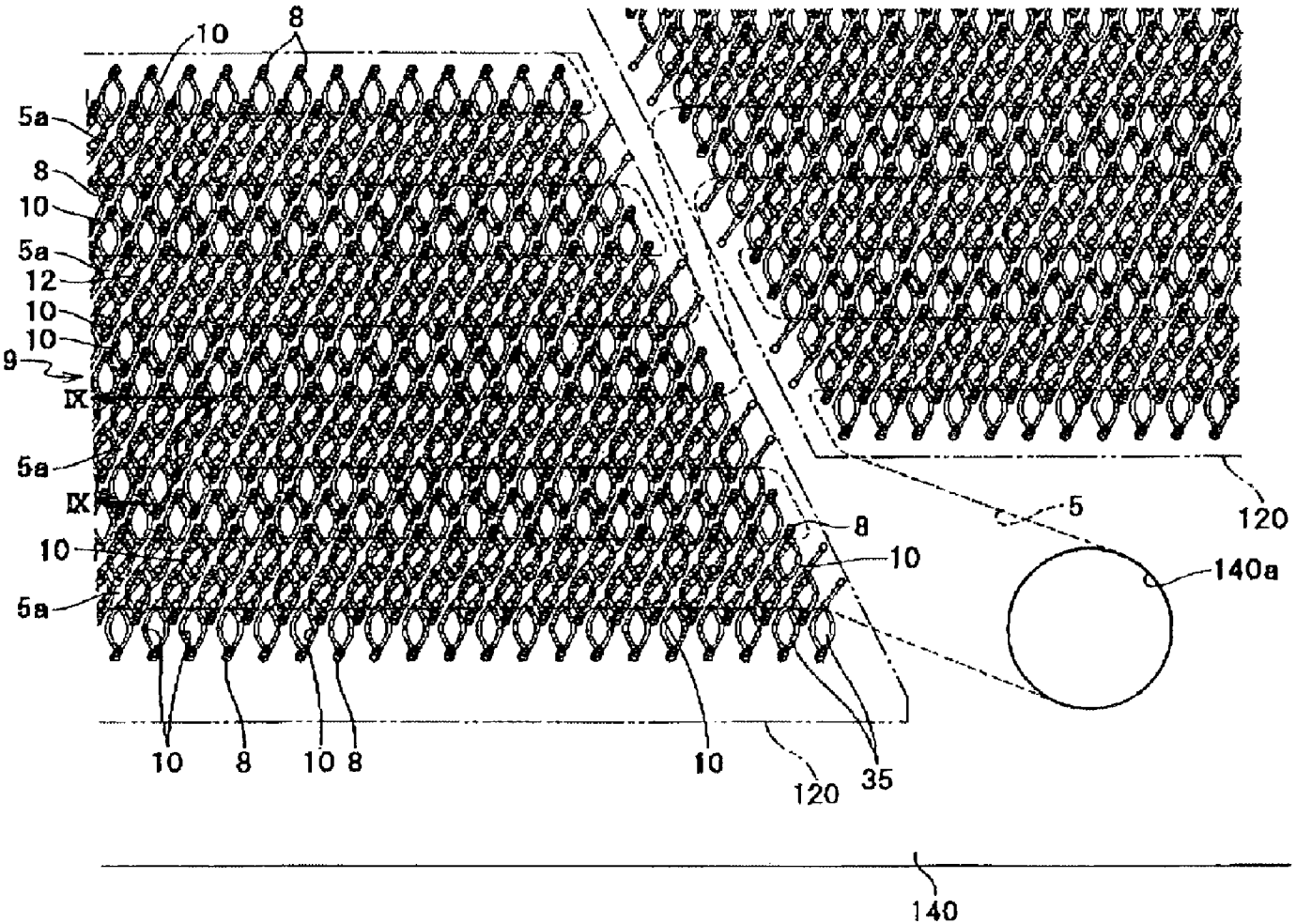
FIG. 8 is an enlarged, plan view of an area surrounded by the dashed line in FIG. 7A.

Referring to FIG. 8, a plurality of sub-manifold flow passages 5*a* may branch from the manifold flow passage 5. The sub-manifold flow passages 5*a* may extend adjacently to each other in an area opposed to each actuator unit 120 inside the flow passage unit 140.

The flow passage unit 140 may comprise a pressure chamber group 9 in which a plurality of pressure chambers 10 are formed, e.g., in a matrix. The pressure chamber 10 may be a hollow area having a planar, substantially diamond shape with the rounded corner portion. The pressure chamber 10 may open on the upper surface of the flow passage unit 140. The pressure chambers 10 may be arranged substantially over the face of the area opposed to the actuator unit 120 on the upper surface of the flow passage unit 140. Consequently, each pressure chamber group 9 occupies the area of about same size and shape as the actuator unit 120. Moreover, the opening of each pressure chamber 10 may be blocked by bonding the actuator unit 120 on the upper surface of the flow passage unit 140.

In this embodiment, sixteen rows of pressure chambers 10 may be arranged at equal intervals in the direction of the length of the flow passage unit 140 in parallel to each other in the direction of the width. The number of pressure chambers 10 in each pressure chamber row may gradually decrease from the longer side to the shorter side which corresponds to the outer shape of the actuator unit 120. The nozzles 8 may be similarly arranged.

An individual electrode 35 may be opposed to each pressure chamber 10 on the upper surface of the actuator unit 120. The individual electrode 35 may be a size smaller than the pressure chamber 10 and may have a similar shape to the pressure chamber 10, and may be disposed to be accommodated within the area opposed to the pressure chamber 10 on the upper surface of the actuator unit 120.

The flow passage unit 140 may comprise a plurality of the nozzles 8. The nozzles may be arranged at positions which do not include the area opposed to the sub-manifold flow passage 5*a* on the under surface of the flow passage unit 140. Moreover, the nozzles 8 may be positioned within the area opposed to the actuator unit 120 on the under surface of the flow passage unit 140, and the nozzles 8 within respective areas may be arranged at equal intervals along the direction of the length of the flow passage unit 140.

The nozzles 8 may be formed at positions, such that the projection points of each nozzle 8 onto an imaginary line, which is parallel to the direction of the length of the flow passage unit 140 from the direction perpendicular to the imaginary line, are arranged without a break at equal intervals corresponding to the print resolution. Thereby, the inkjet head 100 may perform printing without a break at the interval corresponding to the print resolution over the substantially entire area where the nozzles 8 are position in the direction of the length of the flow passage unit 140.

A number of apertures/diaphragms 12 may be positioned inside the flow passage unit 140, and the apertures 12 may be arranged within the area opposed to the pressure chamber group 9. The apertures 12 may extend along a direction parallel to the horizontal plane.

Figure 9:
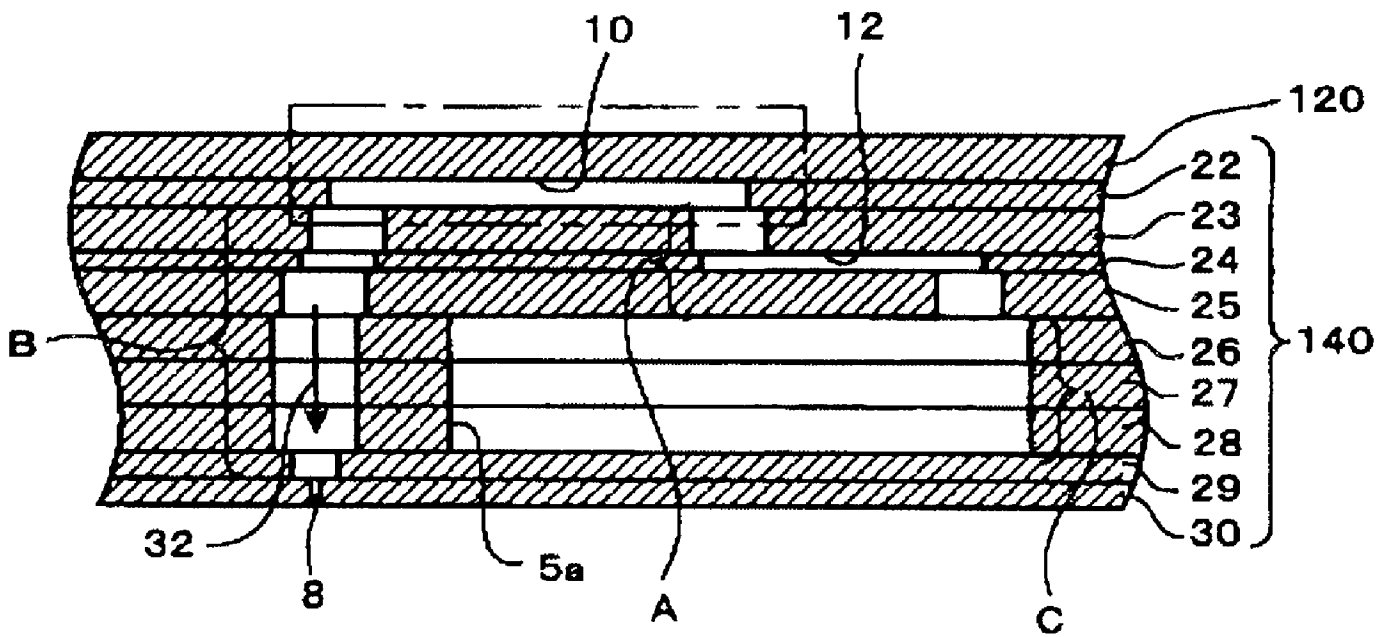
FIG. 9 is a longitudinal, cross-sectional view along the line IX-IX of FIG. 8.

A communication pore for providing fluid communication between the aperture 12, the pressure chamber 10, and the nozzle 8 may be formed inside the flow passage unit 140. Referring to FIG. 9, the communication pores be in fluid communication with each other to comprise the individual ink flow passages 32. Each individual ink flow passage 32 may be in fluid with the sub-manifold flow passage 5*a*. The ink supplied to the manifold flow passage 5 may be provided via the sub-manifold flow passage 5*a* to each of the individual ink flow passages 32, and then may be discharged from the nozzle 8.

The flow passage unit 140 may comprise a laminated structure comprising a cavity plate 22, a base plate 23, an aperture plate 24, a supply plate 25, the manifold plates 26, 27 and 28, a cover plate 29 and a plate 30, which may be positioned in the order from the upper surface of the flow passage unit 140. The plates may have a plurality of communication pores formed the therethrough, and may be aligned and laminated, such that the communication pores are in fluid communication with each other to comprise the individual ink flow passages 32 and the sub-manifold flow passages 5*a*. The portions comprising the individual ink flow passage 32 may be disposed in proximity with respect to each other at different positions, such that the pressure chamber 10 may be on the upper surface of the flow passage unit 140, the sub-manifold flow passage 5*a* may be in the central portion inside, and the nozzle 8 may be on the under surface. Consequently, the sub-manifold flow passage 5*a* and the nozzle 8 may be in fluid communication via the communication pore.

With respect to the communication pores, the first communication pore may be the pressure chamber 10 formed on the cavity plate 22, and the second communication pore may be the communication pore A comprising the flow passage in fluid communication from one end of the pressure chamber 10 to the sub-manifold flow passage 5*a*. The communication pore A may be formed on each plate from the base plate 23, e.g., the entrance into the pressure chamber 10, to the supply plate 25 e.g., the exit from the sub-manifold flow passage 5*a*. The communication pore A may comprise the aperture 12 formed on the aperture plate 24.

The third communication pore may be a communication pore B comprising the flow passage in fluid communication from the other end of the pressure chamber 10 to the nozzle 8. The communication pore B may be formed on each plate from the base plate 23 to the cover plate 29. The fourth communication pore may be the nozzle 8 formed on the nozzle plate 30, and the fifth communication pore may be the communication pore C comprising the sub-manifold flow passage 5*a*. The communication pore C may be formed on the manifold plates 26-28.

The communication pores may be in fluid communication with each other, and may comprise the individual ink flow passage 32 leading from an inflow port of the ink from the sub-manifold flow passage 5*a* to the nozzles 8. The ink supplied to the sub-manifold flow passage 5*a* flows into the nozzle 8 via the following described path. First, the ink flows upwards from the sub-manifold flow passage 5*a* to one end of the aperture 12. Then, the ink flows horizontally along the extending direction of the aperture 12 to the other end of the aperture 12. The ink then flows upwards to one end of the pressure chamber 10, and then horizontally along the extending direction of the pressure chamber 10 to the other end of the pressure chamber 10. The ink then flows from obliquely downwards via the plates to the nozzle 8.

Figure 10:
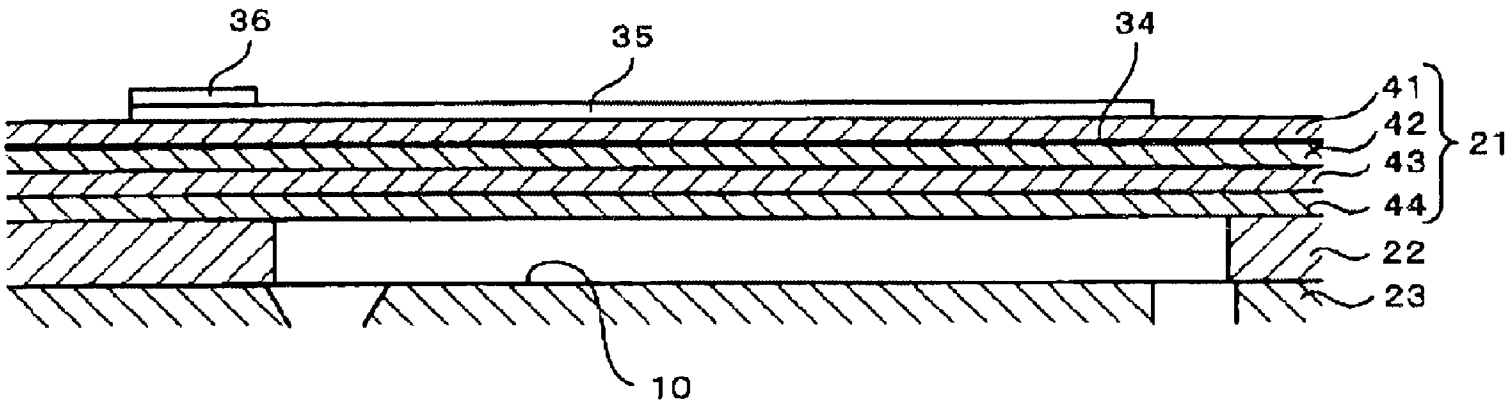
FIG. 10 is an enlarged view of an area surrounded by the dashed line in FIG. 9.

Referring to FIG. 10, the actuator unit 120 may have a laminated structure in which four piezoelectric layers 41, 42, 43, and 44 are laminated. Each of the piezoelectric layers 41 to 44 may have a thickness of about 15 mm, and the total thickness of the actuator unit 120 may be about 60 mm. Referring to FIG. 8, each of the piezoelectric layers 41-44 may extend over a plurality of pressure chambers 10. The piezoelectric layers may comprise a ceramics material comprising lead zirconate titanate having ferroelectricity.

The actuator unit 120 may comprise an individual electrode 35 and a common electrode 34 comprising a metal material such as Ag—Pd. The individual electrode 35 may be positioned opposed to the pressure chamber 10 on the upper surface of the actuator unit 120. One end of the individual electrode 35 may be drawn out of the area opposed to the pressure chamber 10 to form a land 36. The land 36 may comprise gold, e.g., gold comprising glass frit, and may be convex and have a thickness of about 15 mm. The land 36 may be electrically connected to a plurality of wirings 162*a* of the FPC 162.

When the inkjet head 100 is installed in the printer, the control portion of the control board may be electrically connected to the main control portion of the printer. The control portion of the control board 170 instructs the driver IC 160 to supply a voltage pulse corresponding to ink discharge in accordance with an instruction of the main control portion of the printer. The driver IC 160 supplies a voltage pulse corresponding to ink discharge through the FPC 162 to the individual electrode 35 in response to the instruction.

The common electrode 34 may be interposed over substantially the entire surface in the face direction in an area between the piezoelectric layer 41 and the piezoelectric layer 42. For example, the common electrode 34 may extend over the pressure chambers 10 within the area opposed to the actuator unit 120. The thickness of the common electrode 34 may be about 2 mm, and the common electrode 34 may be grounded and held at the ground potential.

The plurality of individual electrodes 35 and the common electrode 34 may sandwich the uppermost piezoelectric layer 41. An area on the piezoelectric layer sandwiched between the individual electrodes 35 and the common electrode 34 may be considered an active site. In the actuator unit 120 of an embodiment, and the uppermost piezoelectric layer 41 comprises the active site, the other piezoelectric layers 42-44 do not comprise the active site, e.g., the actuator unit 120 may be uni-morph type actuator.

The volume of the pressure chamber 10 corresponding to the individual electrode 35 may be altered by selectively supplying a predetermined voltage pulse to the individual electrode 35, such that a pressure is applied to the ink within the pressure chamber. Thereby, the ink may be discharged via the individual ink flow passage 32 from the corresponding nozzle 8, and a desired image may be formed on the paper.

In the inkjet head 100, heat of the driver IC 160 may be conveyed to the inside surface 152 of the heat sink 150 and may be radiated to the outside surface 151 from the heat sink 150. Therefore, heat conveyed from the heated driver IC 160 to the inside surface 152 is less likely to be radiated from the inside surface 152 to the closed space. Consequently, the closed space is less likely to have a relatively high temperature or a relatively high humidity, whisker growth at the electrically connected portion between the FPC 162 and the actuator unit 140. Moreover, a rise in the ink temperature within the ink reservoir 130 and the ink flow passage in the flow passage unit 140 can be suppressed. Therefore, the viscosity of ink is more stable, and the ink discharge is more stable.

Because the adiabatic layer 155 may be formed on the inside surface 152 of the heat sink 150, if heat conveyed from the area on the inside surface 152 opposed to the driver IC 160 to the heat sink 150 is radiated from the area on the inside surface 152 not opposed to the driver IC 160, the closed space surrounded by the head cover 110 is less likely to be heated because of the adiabatic layer 155 exists.

Figure 11:
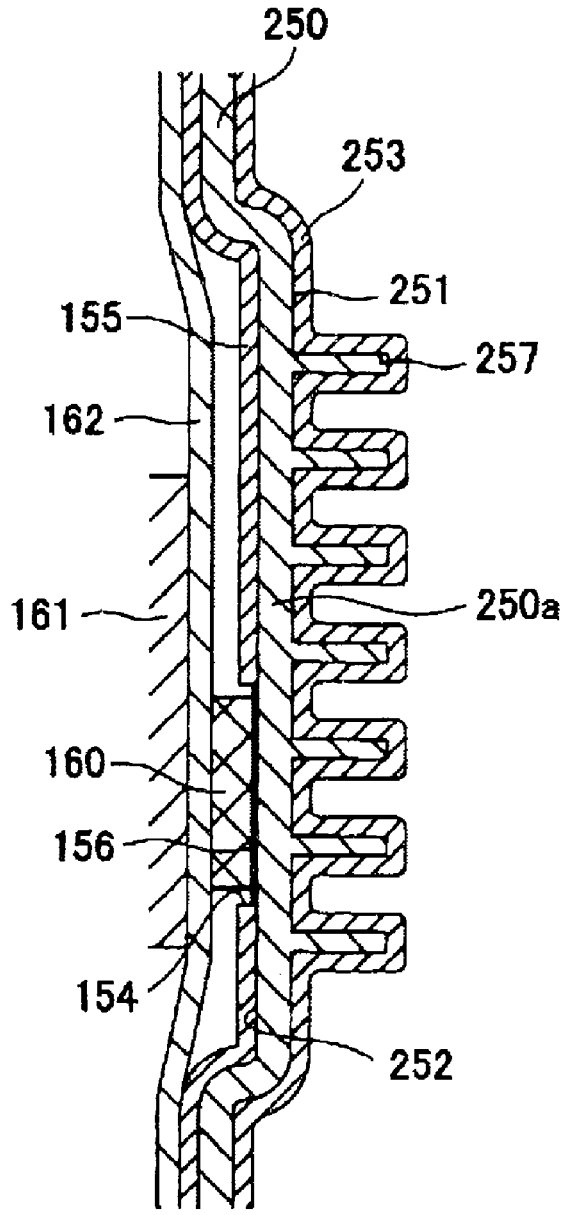
FIG. 11 is a partial, enlarged cross-sectional view near a heat sink provided on an inkjet head, according to a another embodiment of the present invention.
Figure 11:
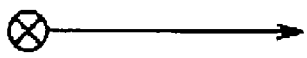

Referring to FIG. 11 another embodiment of the present invention is substantially similar to the above embodiments of the present invention. Therefore only differences between this embodiment of the present invention and the above described embodiments are discussed with respect to this embodiment. Specifically, in this embodiment, heat sink 150 is replaced by heat sink 250.

The heat sink 250 may comprise a flat protrusion 250*a* similar to the flat protrusion 150*a*. The heat sink 250 may comprise a plurality of convex portions 257 protruding in the subscanning direction from the outside surface 251 of the flat protrusion 250*a*. The convex portions 257 may spread in the main scanning direction on the flat protrusion. In this manner, because the plurality of convex portions 257 may be positioned on the outside surface 251 of the heat sink 250, the surface area of the outside surface 251 of the heat sink 250 may be greater than that of the inside surface 252. Therefore, the heat radiation characteristic on the outside surface of the heat sink 250 may be greater than on the inside surface 252, such that heat conveyed to the inside surface 252 of the heat sink 250 is radiated in the direction from the inside surface 252 to the outside surface 251 from the heat sink 250.

The heat sink 250 may comprise aluminum metal, and a porous film 253 on the outside surface 251, similar above described embodiments. Thus, the surface area of the outside surface of the heat sink 250 may be greater than that of the inside surface 252. Therefore, heat conveyed to the inside surface 252 is radiated in the direction from the inside surface 252 to the outside surface 251 from the heat sink 250. In this manner, the heat radiation characteristic may be greater on the outside surface of the heat sink 250 than on the inside surface 252, such that heat of the driver IC 160 conveyed to the heat sink 250 is less likely to be radiated to the closed space, and the closed space is less likely to be heated.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An inkjet head comprising:

a flow passage unit having an ink flow passage formed therein, wherein ink flows within the ink flow passage;

an actuator unit secured to the flow passage unit, wherein the actuator unit is configured to apply a discharge energy to the ink within the ink flow passage;

a driver IC configured to supply a drive signal to the actuator unit;

a plurality of plates extending from the flow passage unit;

an adiabatic layer disposed on one of the plurality of plates, wherein the adiabatic layer has an opening formed therethrough, and the driver IC is disposed within the opening; and a cover member secured to the plurality of plates, wherein the cover member, the plurality of plates, and the flow passage unit define a closed space, and the driver IC is disposed within the closed space, wherein the driver IC opposes at least a portion of an inside surface of the one of the plurality of plates and is thermally coupled to the one of the plurality of plates, and an outside surface of the one of the plurality plates has a heat radiation property which is greater than a heat radiation property of the inside surface of the one of plurality of plates.

2. The inkjet head of claim 1, wherein the outside surface of the one of the plurality of plates comprises at least one protruding portion which extends therefrom.

3. The inkjet head of claim 2, wherein the outside surface of the one of the plurality of plates is convex.

4. The inkjet head of claim 3, wherein an end of the at least one protruding portion is convex.

5. The inkjet head of claim 1, wherein the plurality of plates comprise at least one of titanium, magnesium, aluminum, titanium alloy, magnesium alloy, and aluminum alloy.

6. The inkjet head of claim 5, wherein the plurality of plates comprise aluminum or aluminum alloy.

7. The inkjet head of claim 1, wherein a porous film is formed on the outside surface of the plurality of plates.

8. The inkjet head of claim 7, wherein the porous film comprises an anodized porous black film.

9. The inkjet head of claim 1, wherein a thickness of the adiabatic layer is less than or equal to a height of the driver IC in the thickness direction of the adiabatic layer.

10. The inkjet head of claim 1, wherein the adiabatic layer comprises an insulating material.

* * * * *